US009102496B2

(12) United States Patent
Kyotani

(10) Patent No.: US 9,102,496 B2
(45) Date of Patent: Aug. 11, 2015

(54) RECORDING MEDIUM DISCHARGING APPARATUS AND COMPUTER-READABLE MEDIUM STORING RECORDING MEDIUM DISCHARGING PROGRAM

(71) Applicant: Brother Kogyo Kabushiki Kaisha, Nagoya-shi, Aichi-Ken (JP)

(72) Inventor: Tadao Kyotani, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/329,189

(22) Filed: Jul. 11, 2014

(65) Prior Publication Data

US 2015/0035218 A1 Feb. 5, 2015

(30) Foreign Application Priority Data

Jul. 31, 2013 (JP) ..... 2013-158746

(51) Int. Cl.

*B65H 31/24* (2006.01)
*B65H 43/06* (2006.01)
*B65H 39/11* (2006.01)
*B65H 43/08* (2006.01)

(52) U.S. Cl.

CPC ..... *B65H 31/24* (2013.01); *B65H 39/11* (2013.01); *B65H 43/06* (2013.01); *B65H 43/08* (2013.01); *B65H 2408/111* (2013.01); *B65H 2511/30* (2013.01); *B65H 2511/31* (2013.01); *B65H 2511/51* (2013.01); *B65H 2513/50* (2013.01); *B65H 2515/112* (2013.01); *B65H 2601/211* (2013.01); *B65H 2601/271* (2013.01); *B65H 2801/06* (2013.01)

(58) Field of Classification Search

CPC ..... B65H 29/00; B65H 29/001; B65H 31/24; B65H 33/00; B65H 33/14; B65H 43/00; B65H 43/06; B65H 2511/152; B65H 2511/30; B65H 2513/10; B65H 2513/50; B65H 2557/60; B65H 2557/00; B65H 2601/271; B65H 2601/421

USPC ..... 271/176, 207, 298

See application file for complete search history.

(56) References Cited

U.S. PATENT DOCUMENTS 3,951,264 A * 4/1976 Heidecker et al. ..... 206/308.3
7,722,041 B2 * 5/2010 Honda ..... 271/288
2011/0249052 A1 * 10/2011 Ueno ..... 347/16

FOREIGN PATENT DOCUMENTS

JP 2009-274844 11/2009

* cited by examiner

*Primary Examiner* — David H Bollinger

(74) *Attorney, Agent, or Firm* — Frommer Lawrence & Haug LLP

(57) ABSTRACT

There is provided a recording medium discharging apparatus including: a support tray; a discharging mechanism configured to discharge the recording media; a detector configured to detect a specific state in which a position of an uppermost surface of the recording media is not lower than a predetermined position; and a controller configured to control the discharging mechanism. When executing a job for continuously discharging the recording media on the support tray at a predetermined discharge interval, the controller is configured to control the discharging mechanism to pause discharge of the recording media on the support tray under a condition that the detector keeps detecting the specific state until a predetermined number of pieces of the recording medium is discharged on the support tray since the detector has detected the specific state, and is configured to set the predetermined number to be greater as the discharge interval is shorter.

10 Claims, 6 Drawing Sheets

RECORDING MEDIUM DISCHARGING APPARATUS AND COMPUTER-READABLE MEDIUM STORING RECORDING MEDIUM DISCHARGING PROGRAM

CROSS REFERENCE TO RELATED APPLICATION

The present application claims priority from Japanese Patent Application No. 2013-158746 filed on Jul. 31, 2013 the disclosure of which is incorporated herein by reference in its entirety.

BACKGROUND OF THE INVENTION

1. Field of the Invention

The present invention relates to a recording medium discharging apparatus which discharges a recording medium onto a support tray and a computer-readable medium storing a recording medium discharging program which is executable by a controller of the recording medium discharging apparatus.

2. Description of the Related Art

Conventionally, as a recording medium discharging apparatus which discharges a recording medium on a support tray, there is known a paper post-processing apparatus which is arranged on a side portion or a lateral portion of an image forming apparatus.

The above-described paper post-processing apparatus is provided with a support tray configured to be movable in an updown direction (also referred to as a "discharge tray"), and a pendulum sensor configured to detect whether or not a recording medium is present on the support tray and to detect whether or not the recording media discharged on the support tray have reached a maximum height, namely to detect the presence or absence of a full stack state. In a case that the full stack state of the support tray is detected by the pendulum sensor, the support tray is moved downward so that the recording media can be further discharged on the support tray. When the support tray is moved downward to arrive at the lowermost end position therefor, the image forming apparatus is stopped.

SUMMARY OF THE INVENTION

On the other hand, in a case that a job for continuously discharging a plurality of pieces of the recording medium on the support tray is executed, air is retained between the recording media discharged and stacked on the support tray, thus making the entire thickness of the recording media stacked on the support tray be greater than the actual thickness of the stacked recording media. Such a phenomenon is referred to as "floating". Since the air retained between the recording media leaks or seeps out as the time passes, and thus even though the full stack state has been detected by the pendulum sensor in the above-described paper post-processing apparatus, the full stack state is canceled or dissolved afterwards in some cases. Namely, in this paper post-processing apparatus, there is still some additional capacity or margin for discharging the recording medium on the support tray in some cases, even when the support tray is moved down to the lowermost end position.

In view of the above situation, an object of the present teaching is to provide a recording medium discharging apparatus capable of discharging the recording medium up to a target position on the support tray in an assured manner, and to provide a recording medium discharging program executable by a controller of the recording medium discharging apparatus.

In order to solve the above problem, the inventor of the present teaching found out, through the diligent studies and investigations, that the amount of air retained between the recording media discharged on the support tray greatly depends on a discharge interval at which the recording media are continuously discharged. Here, the term "discharge interval" is a time interval between two pieces of the recording medium which are discharged continuously; provided that a printing velocity V at which a recording medium is printed is V [ppm], the discharge interval is 60V [s]. The present teaching is made from such a viewpoint.

According to a first aspect of the present teaching, there is provided a recording medium discharging apparatus configured to discharge a recording medium, including:

a support tray configured to support the recording medium;

a discharging mechanism configured to discharge a plurality of pieces of the recording medium to the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism, wherein in a case of executing a job for continuously discharging the plurality of pieces of the recording medium on the support tray at a predetermined discharge interval, the controller is configured to control the discharging mechanism to pause discharge of the plurality of pieces of the recording medium on the support tray under a condition that the detector keeps detecting the specific state until a predetermined number of pieces of the recording medium is discharged on the support tray since the detector has detected the specific state, and the controller is configured to set the predetermined number of pieces of the recording medium to be greater as the discharge interval is shorter.

According to the above-described configuration, the predetermined number of pieces of the recording medium is kept continuously discharged on the support tray even after the controller has detected, via the detector, the specific state. Accordingly, even when the air leeks out between the recording media stacked on the support tray, the position of the uppermost surface of the recording media can be maintained at the position same as or higher than the predetermined position. Further, since the predetermined number of pieces at which the recording medium can be continuously discharged is set to be greater as the discharge interval of the job is shorter, the above-described effect can be obtained regardless of the magnitude of the discharge interval. With this, it is possible to discharge the recording media up to a target position on the support tray in an assured manner.

According to a second aspect of the present teaching, there is provided a recording medium discharging apparatus configured to discharge a recording medium, including:

a support tray configured to support the recording medium;

a discharging mechanism configured to discharge a plurality of pieces of the recording medium on the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism, wherein in a case of executing a job for continuously discharging the plurality of pieces of the recording medium on the support tray at a predetermined discharging interval, the controller is configured to control the discharging mechanism to pause discharge of the plurality of pieces of the recording medium under a condition that the detector detects the specific state, and to resume the discharge of the plurality of pieces of the recording medium under a condition that the detector does not detect the specific state after a predetermined period of time has elapsed since detection of the specific state by the detector, and the controller is configured to set the predetermined period of time to be greater as the discharge interval is shorter.

According to the above configuration, the predetermined period of time becomes a stand-by period of time after the controller has detected the specific state via the detector, and thus the discharge of the recording media can be resumed after the air between the recording media discharged on the support tray has been sufficiently leaked out. As a result, the position of the uppermost surface of the recording media can be maintained at a position same as or higher than the predetermined position. Further, the predetermined period of time becoming the stand-by period of time is set to be longer as the discharge interval of the job is shorter. Accordingly, the above-described effect can be obtained regardless of the magnitude of the discharge interval. With this, it is possible to discharge the recording media up to a target position on the support tray in an assured manner.

According to a third aspect of the present teaching, there is provided a non-transitory computer-readable medium storing a recording medium discharging program which is executable in a recording medium discharging apparatus including:

a support tray configured to support the recording medium;

a discharging mechanism configured to discharge a plurality of pieces of the recording medium to the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism, the recording medium discharging program causing the controller to execute:

controlling of the discharging mechanism, in a case that the controller executes a job for continuously discharging the plurality of pieces of the recording medium on the support tray at a predetermined discharging interval, to pause discharge of the plurality of pieces of the recording medium under a condition that the detector keeps detecting the specific state until a predetermined number of pieces of the recording medium is discharged on the support tray since the detector has detected the specific state; and setting of the predetermined number of pieces of the recording medium to be greater as the discharge interval is shorter.

According to the present teaching, it is possible to assuredly discharge the recording medium up to the target position on the support tray.

BRIEF DESCRIPTION OF THE DRAWINGS

FIGS. 4A and 4B are each a schematic view showing a state of recording media discharged on a support tray, wherein FIG. 4A shows a state immediately after the discharge and FIG. 4B shows a state stabilized after a predetermined time has elapsed since the discharge.

DESCRIPTION OF THE PREFERRED EMBODIMENTS

Figure 1:
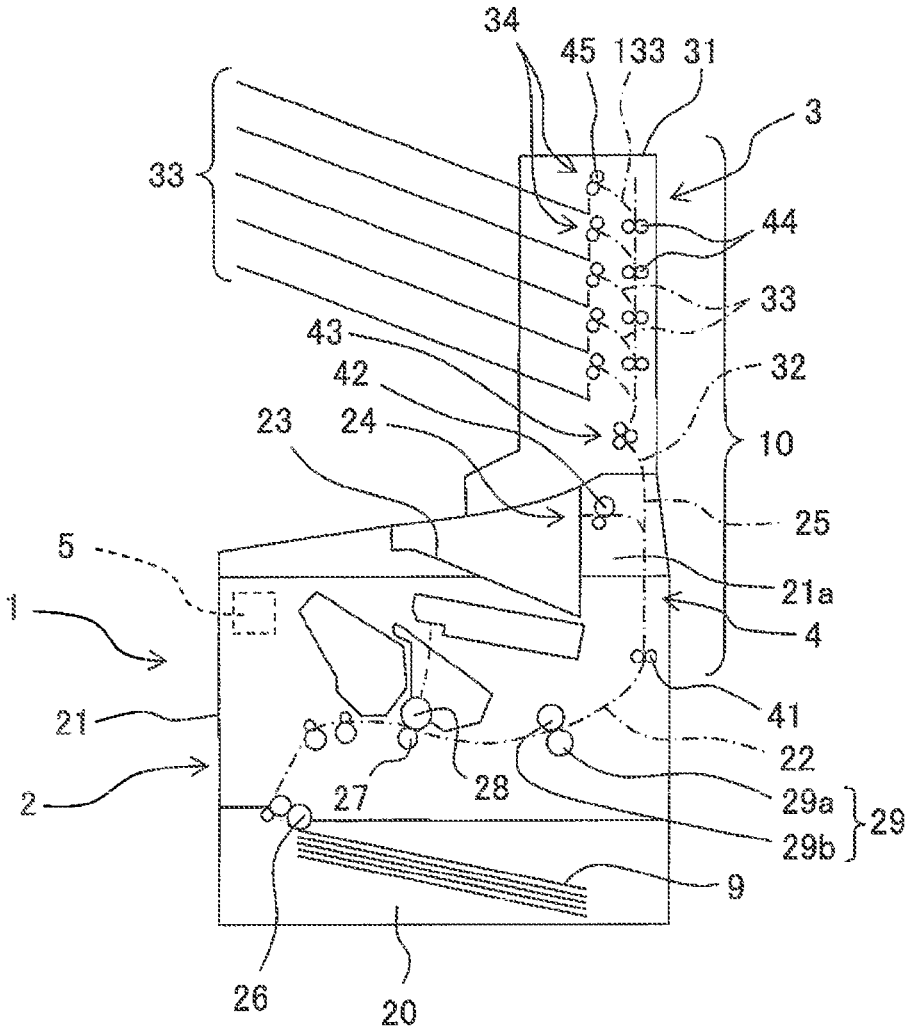
FIG. 1 is a schematic view showing the configuration of an image forming apparatus into which a recording medium discharging apparatus according to an embodiment of the present teaching is incorporated.

An image forming apparatus 1 shown in FIG. 1 includes an image forming unit 2 and a sort unit 3 arranged at a position over or above the image forming unit 2. Note that, however, the sort unit 3 may be arranged on a side portion of the image forming unit 2. Further, as will be described in detail later, the image forming apparatus 1 having a recording medium discharging apparatus 10 incorporated thereinto may be constructed only of the image forming unit 2. Furthermore, it is not necessarily indispensable that the recording medium discharging apparatus 10 is incorporated into the image forming apparatus 1, and the recording medium discharging apparatus 10 may be configured as an apparatus independent from the image forming apparatus 1.

The image forming unit 2 is configured to form an image on a recording medium (for example, paper or sheet) 9. In this embodiment, the image forming unit 2 is a laser printer which is configured to form an electrostatic latent image on a photosensitive drum 28 with a laser light beam, to cause a toner to adhere to the electrostatic latent image so as to form a toner image, and to transfer the toner image on the recording medium 9. Note that, however, the image forming unit 2 may be an inkjet printer configured to form an image on the recording medium 9 with an ink. Further, it is not necessarily indispensable that the image forming unit 2 is a printer, and may be a facsimile machine, a multi-function machine, etc.

Specifically, the image forming unit 2 includes a box-shaped body 21, and a cassette 20 which is detachably installed in the body 21 and which accommodates the recording medium 9 therein. A transporting path 22 which extends from the cassette 20 substantially in a shape of a letter "S" is formed inside the body 21. In the following explanation, a transporting direction when the recording medium 9 is transported in a substantially horizontal posture in a substantially central portion of the transporting path 22 is defined as "backward direction" or "rearward", a direction opposite thereto is defined as "forward direction" or "frontward", and a horizontal direction perpendicular to the forward and backward directions (direction perpendicular to the sheet surface of FIG. 1) is defined as "left/right direction", for convenience of the explanation.

A pickup roller 26 configured to feed the recording medium 9 from the cassette 20 to the transporting path 22 is provided at an upstream end portion of the transporting path 22. A photosensitive drum 28 and a transferring roller 27 are provided at a substantially central location inside the body 21 so as to sandwich the transporting path 22 therebetween, and a plurality of pairs of transporting rollers are provided between the photosensitive drum 28 and the pickup roller 26. Further, a pair of fixing rollers 29 having a heating roller 29*a* and a pressing roller 29*b* is provided at a rear location that is on a side downstream of the photosensitive drum 28.

A main support tray 23 configured to support the recording medium 9 is provided on the upper surface of the body 21. Further, the body 21 is provided with an upright portion 21*a* which is arranged on a rear side of the main support tray 23 and which projects upward higher than the main support tray 23. A downstream portion of the transporting path 22 is formed inside the upright portion 21*a*; a downstream end portion of the transporting path 22 is open on the upper surface of the upright portion 21*a* toward the main support tray 23 so as to define a discharge port 24.

A pair of discharging rollers 42 is provided on the downstream end portion of the transporting path 22, and a pair of transporting rollers 41 is provided between the pair of discharging rollers 42 and the pair of fixing rollers 29. The pair of transporting rollers 41 and the pair of discharging rollers 42 are constituent elements constructing a discharging mechanism 4 configured to discharge the recording medium 9 onto one support tray among the main support tray 23 and a sub support tray 33 (to be described later on). In a case that a plurality of pieces of the recording medium 9 is discharged on the support tray (the main support tray 23 or the sub support tray 33), the recording media 9 are stacked on the support tray.

Further, a bypass path 25 branching from the transporting path 22 is formed inside the upright portion 21*a* of the body 21 such that the bypass path 25 is open on the upper surface of the upright portion 21*a*.

The sort unit 3 has a casing 31 arranged at a position over or above the upright portion 21*a* of the image forming unit 2, and a plurality of pieces (five pieces in the illustrated example) of the sub support tray 33 configured to support the recording medium 9. The sub support trays 33 are extended in an obliquely upward direction from the casing 31 to the frontward direction, and are attached to the casing 31 in a state that the sub support trays 33 are aligned in the up/down direction. Note that the number of the sub support tray 33 is not limited to five, and any number of the sub support tray 33 may be provided as necessary.

A transporting path 32 extending upward from the bypass path 25 of the image forming unit 2 is formed inside the casing 31. A plurality of branching paths 133 each of which is configured to guide the recording medium 9 to one of the sub support trays 33 are branched from the transporting path 32. The downstream end portion of each of the branching paths 133 is open toward one of the sub support tray 33 so as to define a discharge port 34.

A group of uncurling rollers 43 is provided on an upstream portion of the transporting path 32, and a plurality of pairs of transporting rollers 44 are provided on appropriate portions of the transporting path 32. Further, a pair of discharging rollers 45 is provided on a downstream end portion of each of the branching paths 133. The group of uncurling rollers 43, the pairs of transporting rollers 44 and the pairs of discharging roller 45 are also constituent elements of the above-described discharging mechanism 4.

A controller 5 is arranged inside the body 21 of the image forming unit 2. A print job is input to the controller 5 from, for example, an external personal computer, etc. The controller 5 controls a device or unit configured to form an image so as to form the image on the recording medium 9, and controls the discharging mechanism 4 so as to discharge the recording medium 9 having the image formed thereon onto the main support tray 23 or one of the sub support trays 33. The recording medium discharging apparatus 10 of this embodiment includes the main support tray 23, the sub support trays 33, the controller 5 and a detector 6 which will be described later on.

Figure 2:
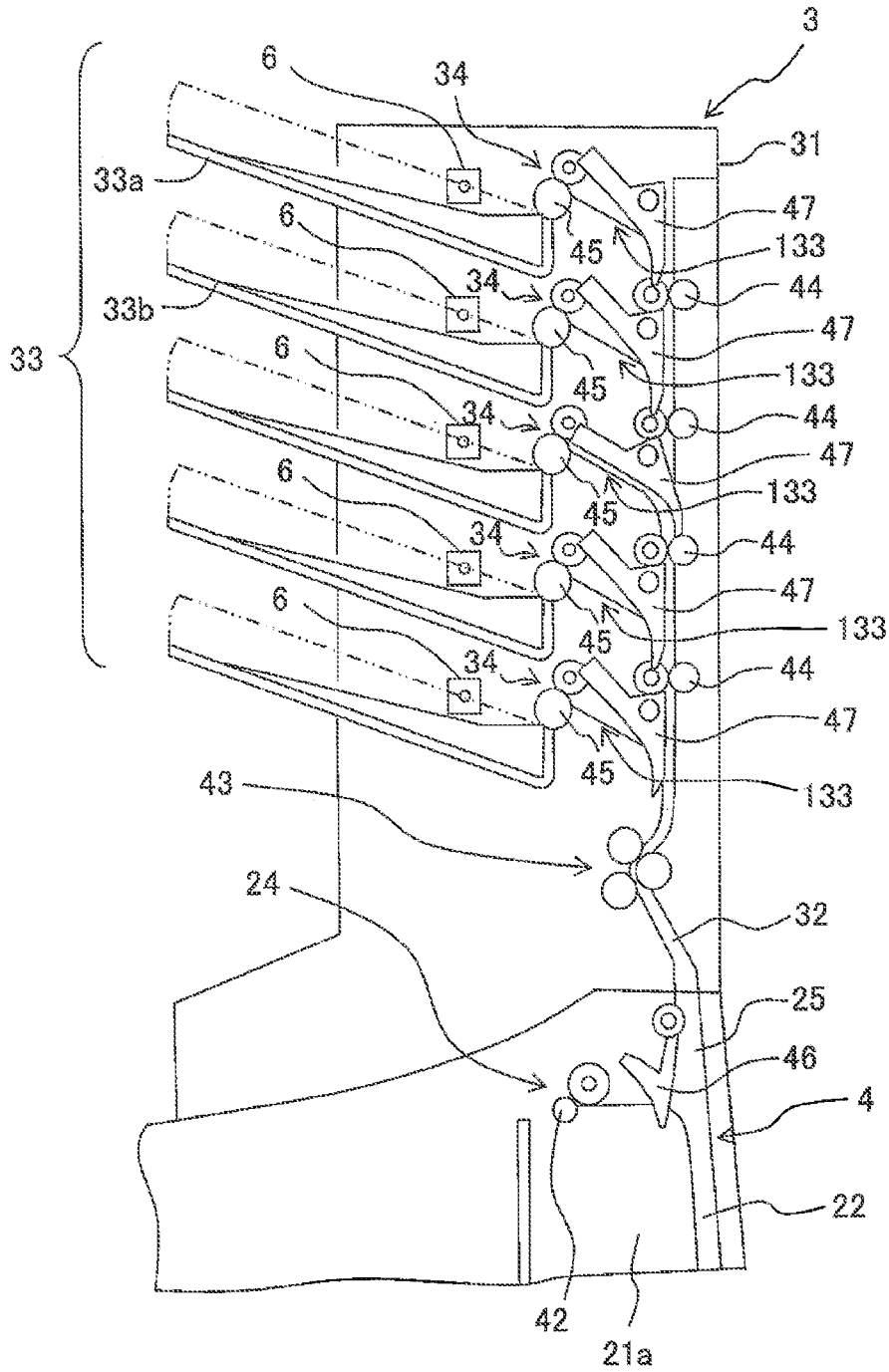
FIG. 2 is an enlarged view of main components or parts of the image forming apparatus shown in FIG. 1.

Next, the configuration of the discharging mechanism 4 and those around the discharging mechanism 4 will be explained with reference to FIG. 2.

The discharging mechanism 4 includes a first flapper 46 arranged at a position at which the bypass path 25 of the image forming unit 2 is branched from the transporting path 22, and a plurality of second flappers 47 each arranged at a position at which one of the branching paths 133 of the sort unit 3 is branched from the transporting path 32. The first flapper 46 is configured to switch whether the recording medium 9 is to be transported along the transporting path 22 or the recording medium 9 is to be introduced to the bypass path 25, and is driven by a solenoid (not shown in the drawings). Each of the second flappers 47 is configured to switch whether the recording medium 9 is to be transported along the transporting path 32 or to be introduced into one of the branching paths 133, and is driven by a solenoid (not shown in the drawings).

Detectors 6 are provided on the casing 31 of the sort unit 3, each at a position in the vicinity of one of the discharge ports 34. Each of the detectors 6 is configured to detect a specific state wherein the position of the uppermost surface of the recording media 9 supported by one of the sub support trays 33 is same as or higher than a predetermined position depicted by two-dot-chain lines in FIG. 2. Here the "predetermined position" is determined from the viewpoint of preventing any jam on the sub support tray 33 and/or from the viewpoint of preventing the recording media 9 from overflowing off the sub support tray 33. In the following description, the "specific state" is referred to as a "full stack state" so that the present teaching can be easily understood.

In the embodiment, each of the detectors 6 is an optical sensor having a light projecting section and a light receiving section which are arranged to be apart from each other in the left/right direction with one of the sub support trays 33 intervened therebetween. Note that, however, the detector 6 may be of any system, and may be, air example, a pendulum sensor which has a pendulum and which causes the end portion of the pendulum to abut against the uppermost surface of the recording media 9 stacked on the sub support tray 33 and detects the position of the uppermost surface of the recording media 9 based on the position of the pendulum. Each of the detectors 6 is connected to the above-described controller 5.

Figure 3:
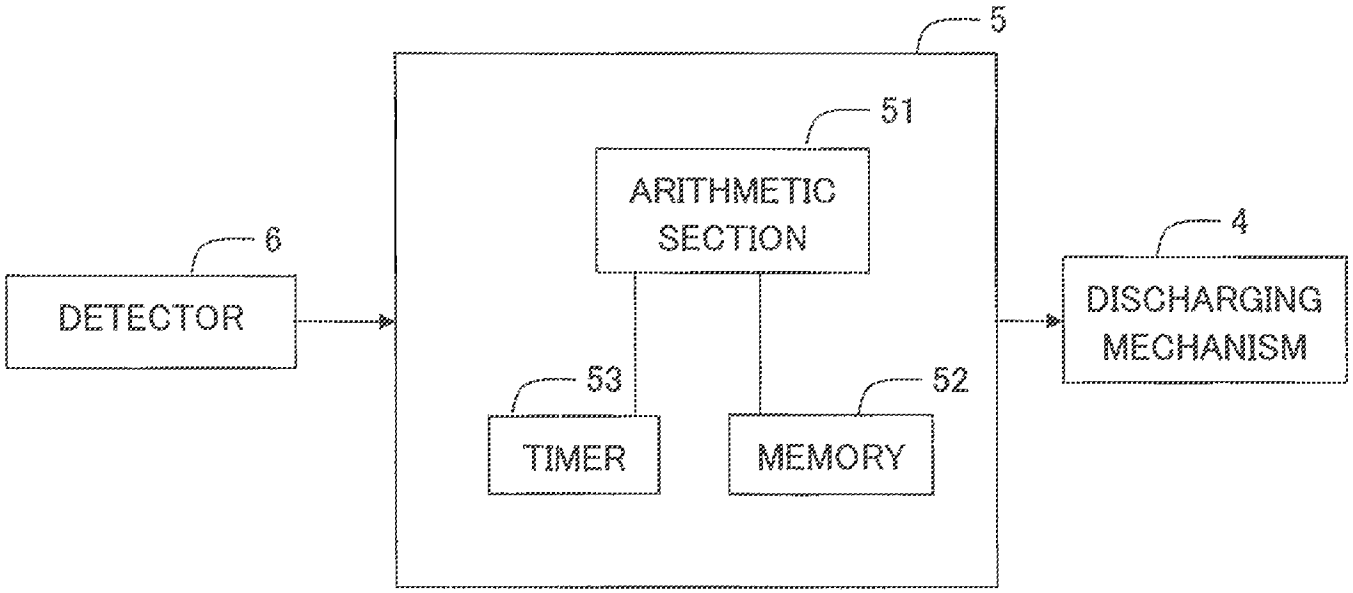
FIG. 3 is a block diagram of a control system relating to the recording medium discharging apparatus in the image forming recording apparatus shown in FIG. 1.

As shown in FIG. 3, the controller 5 has an arithmetic section 51, a memory 52 and a timer 53. A recording medium discharging program is stored in the memory 52, and the arithmetic section 51 executes the recording medium discharging program.

The arithmetic section 51 may include a single CPU (Central Processing Unit), or may be a combination of a plurality of CPUs. Alternatively, the arithmetic section 51 may be a combination of one or more CPU(s) and one or more ASIC(s)

(Application Specific Integrated Circuit). In such a case, the ASIC may be arranged for example inside the sort unit 3, and may be connected to the CPU via an interface.

The detector 6 outputs a detection signal to the controller 5 while the light projected from the light projecting section to the light receiving section is interrupted (cut off) by the recording medium 9 discharged from the discharge port 34. There is assumed such a case that the recording medium 9 passes by in such a manner to interrupt the light projected from the light projecting section toward the light receiving section. However, in this case that the recording medium 9 is just passing by, a period of time during which the light from the light projecting section to the light receiving section is interrupted is short. Therefore, in order to distinguish this case that the recording medium is passing by so as to interrupt the light projected from the light projecting section toward the light receiving section only for a short period of time as described above, the arithmetic section 51 of the controller 5 judges that the position of the uppermost surface of the recording media 9 supported by the sub support tray 33 is same as or higher than the predetermined position under a condition that the period of time during which the light from the light projecting section to the light receiving section is interrupted is not less than a threshold value, and the arithmetic section 51 detects the full stack state.

Note that the output signal of the detector 6 is not limited to that described above, and may be changed as appropriate. For example, the detector 6 may be such a detector that outputs a detection signal while the light from the light projecting section to the light receiving section is not interrupted. Alternatively, the detector may be such a detector that outputs detection signals when the light from the light projecting section to the light receiving section is interrupted and when the interruption of the light is dissolved or canceled, respectively, namely, the detector may be configured to output the detection signals at both timings when the light from the light projecting section to the light receiving section is interrupted and when the light has arrived again from the light projecting section to the light receiving section.

The print job input to the image forming apparatus 5 includes, as print information, a number of the recording medium 9 on which printing is to be performed, a printing velocity V [ppm], etc. The printing velocity V is determined based on a resolution of an image to be formed, a noise performance of the image forming unit 2, etc. In a case that the controller 5 detects the full stack state via the detector 6, the controller 5 controls the discharging mechanism 4 based on the velocity V at that time.

Figure 4A:
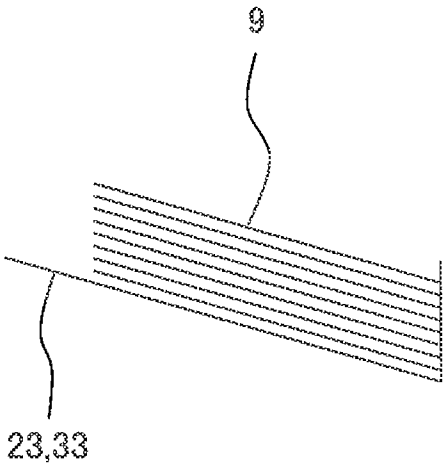
Figure 4B:
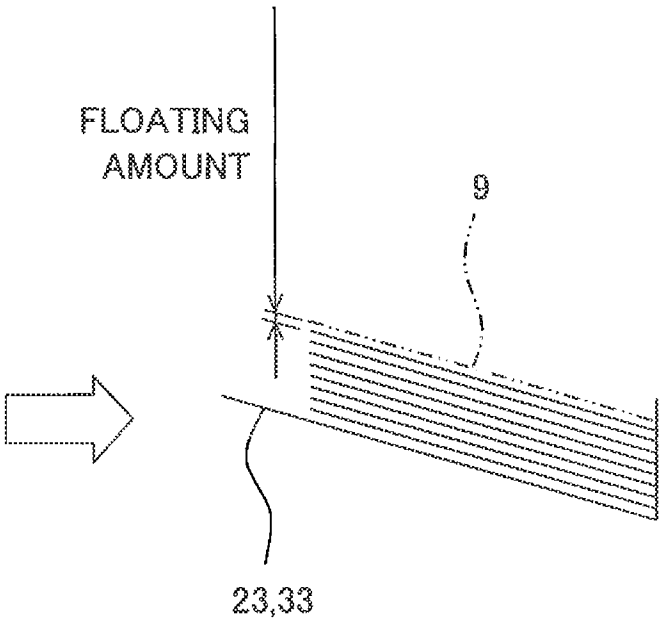
Figure 5:
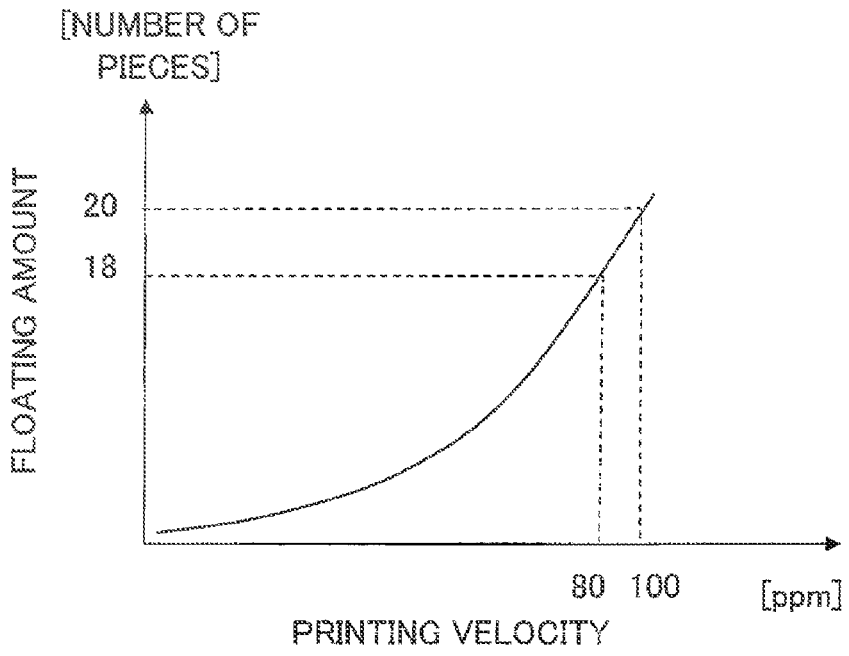
FIG. 5 is a graph showing the relationship between printing velocity and floating amount.

There is assumed such a case that a plurality of pieces of the recording medium 9 are to be printed continuously and that the printing velocity V is great to some extent, in other words in a case that a discharge interval P [s] (P−60/V) at which the recording media 9 are continuously discharged on the support tray is short to some extent. In this case, as shown in FIG. 4A, at first, the total of the thicknesses of the recording media 9 stacked on the support tray is greater than the actual thicknesses of the stacked recording media 9, which in turn causes the position of the uppermost surface of the recording media 9 to be higher than an actual position at which the uppermost surface should actually be located. Note that the actual thickness of the stacked recording media 9 means the thickness of the recording medium multiplied by the number of pieces of the recording medium. This phenomenon is referred to as "floating". However, after elapse of the time to some extent, as shown in FIG. 4B, the position of the uppermost surface of the recording media 9 is settled to the actual position. Namely, the floating is canceled or dissolved. Here, the difference between the position of the uppermost surface of the recording media 9 immediately after having been discharged on the support tray and the position of the uppermost surface of the recording media 9 after being settled is defined as a floating amount H. Further, according to the results of the diligent research and investigation by the inventor of the present teaching, it has been found out that as the printing velocity V is faster, the floating amount H is greater, as shown in FIG. 5. As described above, in a case that a plurality of pieces of the recording medium are discharged continuously on the support tray, the air is retained between the recording media discharged on the support tray, and the air retained between the recording media subsequently seeps or leaks out as the time passes. According to the finding by the inventor, it is considered that the air retained between the recording media which are discharged on the support tray starts to leak out to some extent at the end portions of the recording media even while the recording media are being discharged on the support tray. Namely, in a case that the printing velocity V is fast, the discharge time (a period from a point of time when one piece of the recording media is started to be discharged on the support tray until a point of time when the one piece of the recording media is completely discharged on the support tray) is short and the recording media are stacked on the support tray in the short discharge time. Therefore, the amount of air leaking from between a certain recording medium among the stacked recording media and the uppermost surface of the recording medium stacked below the certain recording medium is small while the recording media are being stacked on the support tray. In contrast to the above case, in another case that the printing velocity V is slow, the recording media are consequently stacked on the support tray in a relatively long period of discharge time. Therefore, the amount of air leaking from between the certain recording medium and the uppermost surface of the recording medium stacked below the certain recording medium is relatively great while the recording media are being discharged on the support tray. As a result, immediately after the recording media have been discharged on the support tray, the amount of air retained between the recording media becomes greater as the printing velocity V is faster; this is presumed as a factor of the floating amount H becoming greater as the printing velocity V is faster.

In the following, the control of the discharging mechanism 4 by the controller 5 will be explained in detail. Note that, however, the following explanation will be given regarding such a case as an example that a sub support tray 33*a* that is the uppermost sub support tray among the plurality of support trays 33 is in the full stack state while the recording media 9 are being discharged on the uppermost sub support tray 33*a*.

When the controller 5 execute a job for discharging a plurality of pieces of the recording medium 9 continuously on the sub support tray 33*a* at a predetermined discharge interval P, the controller 5 controls the discharging mechanism 4 so as to pause discharge of the recording media 9 on the sub support tray 33*a* under a condition that the detector 6 keeps detecting the full stack state until a predetermined number N of pieces of the recording medium 9 is discharged on the sub support tray 33*a* since the detector has detected the full stack state. For example, the controller 5 performs control such that after the predetermined number N of pieces of the recording medium 9 has been discharged on the sub support tray 33*a* since the detection of the full stack state, the recording medium 9 is discharged on a sub support tray 33*b* that is different from the sub support tray 33*a* and is the second uppermost tray among the plurality of sub support trays 33, by outputting a signal to a solenoid (not shown in the drawings) to drive one of the second flappers 47 corresponding to the sub support tray 33*b*. Further, the controller 5 sets the predetermined number N of pieces of the recording medium 9 to be greater as the discharge interval P is shorter.

For example, as shown in FIG. 5, such a case is assumed that the floating amount H corresponds to the total thickness of 20 pieces of the recording medium 9 with respect to the printing velocity V of 100 ppm, and that the floating amount H corresponds to the total thickness of 18 pieces of the recording medium 9 with respect to the printing velocity V of 80 ppm. The memory 52 of the controller 5 stores these floating amounts H as the predetermined numbers N of pieces of the recording medium 9 while being associated with the printing velocities V, respectively, as indicated in the following TABLE 1. Further, the memory 52 also stores reference times T corresponding to the predetermined numbers N of pieces of the recording medium 9, respectively, as indicated in TABLE 1. The reference times T mean time of periods each required for discharging one of the predetermined numbers N pieces of the recording medium 9 at the printing velocity V corresponding thereto. Note that, however, it is allowable that the memory 52 stores only the reference times T, without storing the predetermined numbers N of piece of the recording medium 9.

TABLE 1

| Printing velocity V | Discharge interval P | Predetermined number N of pieces of recording medium | Reference Time T |
|---|---|---|---|
| 100 ppm | 0.6 seconds | 20 pieces | 12 seconds |
| 80 ppm | 0.75 seconds | 18 pieces | 13.5 seconds |

Then, the controller 5 measures a period of time elapsed since the full stack state has been detected by the timer 52, and when the measured time reaches the reference time T corresponding to the printing velocity V, the controller 5 pauses the discharge of the recording media 9 to the sub support tray 33*a* and discharges the remaining recording medium or media 9 to the sub support tray 33*b* different from the sub support tray 33*a*.

In such a manner, according to the recording medium discharging apparatus 10 of the embodiment, the controller 5 continues to discharge the predetermined number N of pieces of the recording medium 9 even after the full stack state has been detected by the detector 6. With this, the position of the uppermost surface of the recording media 9 can be maintained at a position same as or higher than the predetermined position even in a case that the air has leaked from between the recording media 9 discharged on the sub support tray 33*a*. In addition, the predetermined number N of pieces of the recording medium 9 by which the recording media 9 can be continuously discharged is set to be greater as the discharge interval P of the job is shorter, thereby making it possible to obtain the above-described effect regardless of the magnitude of the discharge interval P. With this, it is possible to assuredly discharge the recording media 9 up to the target position on the sub support tray 33*a*.

On the other hand, in a conventional recording medium discharging apparatus provided with a plurality of support trays, when one tray (first support tray) among the plurality of support trays is in the full stack state while the job for discharging the recording media continuously on the first support tray is being executed, the remaining recording medium or media is/are discharged on another support tray (second support tray). After that, in a case that the air between the recording media on the first support tray has leaked out and the full stack state of the first support tray is canceled and that another job for discharging the recording media is executed, the recording media discharged by the another job are discharged on the first support tray, which in turn results in creating such a situation that the recording media of the different jobs are present on the first support tray in a mixed manner.

In view of such a situation associated with the conventional recording medium discharging apparatus, the recording medium discharging apparatus 10 of the embodiment discharges the predetermined number N of pieces of the recording medium 9 on a certain one of the sub support trays 33 even after detecting the full stack state with respect to the certain sub support tray 33, thereby making it possible to prevent the situation that the recording media 9 of the different jobs are present on the certain sub support tray 33 in a mixed manner.

Case of Handling a Plurality of Kinds of Recording Medium Having Mutually Different Weights In such a case that a plurality of kinds of recording medium 9 having mutually different weights are to be discharged by the discharging mechanism 4 on a sub support tray 33, the controller 5 preferably sets the predetermined number N of pieces of a recording medium 9, which is to be used for the print job, to be smaller as the weight of the recording medium 9 is greater. In order to realize the above, it is allowable that the memory 52 stores a table of reference times T in which the reference times T are determined depending on the printing velocities V and the weights of the recording media 9. Alternatively, it is allowable to add coefficients according to the weights to the references times T indicated in TABLE 1, respectively.

The weight of the recording medium 9 depends on the material, the size of the recording medium 9, etc. These pieces of the recording medium information are included in the print job, and thus the controller 5 can grasp or lean the weight of the recording medium 9, for example, from the print job.

As the weight of the recording medium is greater, the period of time required for the air between the recording media 9 discharged on the sub support tray 33 to leak out is also shorter. Accordingly, by setting the predetermined number N to be smaller as the weight of the recording medium 9 is heavier, the position of the uppermost surface of the recording media 9 can be maintained in the vicinity of the predetermined position, regardless of the kinds of the recording medium 9.

Case of Switching the Job while Measuring the Time Elapsed after the Full Stack State has been Detected (I) Case that the Full Stack State Ceases to be Detected while the Jobs are being Switched There is assumed such a case that the controller 5 executes, as the print job, first and second jobs continuously and that the first job is completed before the predetermined number N of pieces of the recording medium is discharged since the detection of the full stack state, and thus the specific state ceased to be detected. In such a case, the controller 5 preferably decreases the predetermined number N of pieces of the recording medium 9 with respect to the second job. For example, in a case that the first and second jobs have a same discharge interval P, the controller 5 may perform such a control with respect to the second job that a period of time, measured after the full stack state has detected and until the first job is completed, is deducted as it is from the reference time T. Alternatively, in a case that the first and second jobs have mutually different discharge intervals P, the controller 5 may perform such a control with respect to the second job that a value is deducted from the reference time T, the value being obtained by adding a coefficient corresponding to the difference between the printing velocities P of the first and second jobs to the period of time measured after the full stack state has detected and until the first job is completed.

According to this configuration, as the position of the uppermost surface of the recording media 9 on the sub support tray 33 when starting the job is closer to the predetermined position, the floating amount of the recording media 9 on the sub support tray 33 when the job is executed is smaller. Therefore, it is possible to perform a control according to the floating amount by decreasing the predetermined number of pieces of the recording medium 9 in a case that the specific state such as the full stack state ceases to be detected (is no longer detected) during the process of continuously executing the first and second jobs.

(II) Case that the Full Stack State is Continuously Detected while the Jobs are being Switched There is assumed such a case that the controller 5 continuously executes, as the print job, first and second jobs of which discharge intervals are mutually different, and that the first job is completed before the predetermined number of pieces of the recording medium 9 is discharged since the detection of the full stack state and the full stack state is still being detected at a point of time at which the second job is started. In such a case, the controller 5 changes the reference time T to a reference time T corresponding to the discharge interval P of the second job, converts a time A required for completing the first job after the detection of the full stack state with a ratio B between the reference time T corresponding to the discharge interval P of the first job and the reference time T corresponding to the discharge interval P of the second job so as to obtain a converted time C, and re-measure the converted time C as already-measured time.

Figure 6A:
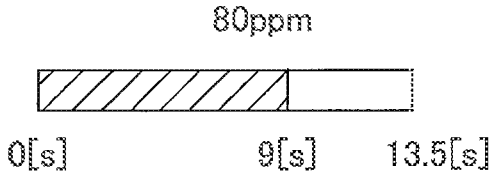
FIGS. 6A and 6B are diagrams for explaining a control method employed when continuously executing first and second jobs which are different in the printing velocity.
Figure 6B:
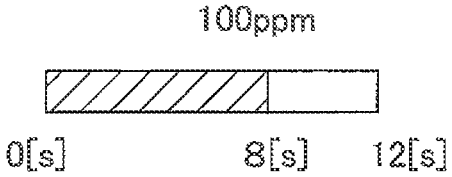

For example, as shown in FIG. 6A, such a case is assumed that the full stack state is detected while executing a first job of which printing velocity V is 80 ppm and that the first job is completed after 9 seconds have elapsed since the detection of the full stack state. Namely, the time A is 9 seconds. Further, it is assumed that the second job having the printing velocity V of 100 ppm is continuously executed following the first job. The reference time T corresponding to the discharge interval P of the first job is 13.5 seconds, and the reference time T according to the discharge interval P of the second job is 12 seconds. Accordingly, the ratio B is 12/13.5 and the time C=A×B=8 seconds. Thus, as shown in FIG. 6B, the controller 5 re-measures the time C as the already-measured time.

Modifications

In the embodiment, the controller 5 measures the time elapsed since the full stack state has been detected by the timer 52. It is allowable, however, that the controller 5 measures the number of pieces of the recording medium 9 discharged on the sub support tray 33*a* since the detector 6 has detected the full stack state, and that the controller 5 pauses the discharge of the recording medium 9 on the sub support tray 33*a* under a condition that the measured number of pieces of the recording medium 9 reaches the predetermined number N of pieces of the recording medium 9 corresponding to the printing velocity V.

Further, when pausing the discharge of the recording medium 9 to the uppermost sub support tray 33 among the sub support trays 33, it is not necessarily indispensable to start the discharge of the recording medium 9 on another sub support tray 33 different from the uppermost sub support tray 33, and the transporting mechanism 4 may be paused or stopped temporarily. For example, in a case that the detector 6 detects the full stack state, the controller 5 may control the discharging mechanism 4 so as to pause the discharge of the recording medium 9 and to resume the discharge of the recording medium 9 under a condition that the detector 6 does not detect the full stack state after a predetermined time D has elapsed since the detector 6 detected the full stack state. Specifically, the controller 5 pauses or stops the discharging mechanism 4 under a condition that the full stack state is detected. In such a case, the controller 5 sets the predetermined time D to be longer as the discharge interval P is shorter. Here, the term "predetermined time D" is a time which is required for the floating of the recording media 9 on the sub support tray 33 is settled and which corresponds to the discharge interval P, and the predetermined time D can be obtained by an experiment, etc.

Even with such a control, there is a stand-by state during the predetermined time D after the detector 6 has detected the full stack state. Thus, the discharge of the recording medium 9 can be resumed after the air between the recording media 9 discharged on the sub support tray 33 has sufficiently leaked out. As a result, it is possible to maintain the position of the uppermost surface of the recording media 9 at a position same as or higher than the predetermined position. In addition, since the predetermined time D becoming the stand-by state is set to be longer as the discharge interval P of the job is shorter, it is possible to obtain the above-described effect regardless of the magnitude of the discharge interval P. With this, it is possible to discharge the recording media 9 assuredly up to the target position on the sub support tray 33.

Other Embodiments

The present teaching is not limited only to the embodiment described above, and may be modified in various ways within a range not deviating from the gist of the present teaching.

For example, the sort unit 3 is not necessarily indispensable. In a case that the sort unit 3 is not provided, the discharging mechanism 4 may be constructed only of the transporting rollers 41 and 42. In this case, the detector 6 may be provided on the body 21 in order to detect the specific state wherein the position of the uppermost surface of the recording media 9 supported on the main support tray 23 of the image forming unit 2 is same as or higher than the predetermined position. Further, a control based on the predetermined time D may be performed in a similar manner as the modification described above.

The recording medium discharging apparatus of the present teaching is useful for a variety of kinds of image forming apparatus.

What is claimed is:

1. A recording medium discharging apparatus configured to discharge a recording medium, comprising:

a support tray configured to support the recording medium;

a discharging mechanism configured to discharge a plurality of pieces of the recording medium to the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism;

wherein, in a case of executing a job for continuously discharging the plurality of pieces of the recording medium on the support tray at a predetermined discharge interval, the controller is configured to control the discharging mechanism to pause discharge of the plurality of pieces of the recording medium on the support tray under a condition that the detector keeps detecting the specific state after a predetermined number of pieces of the recording medium is discharged on the support tray since the detector has detected the specific state; and wherein the controller is configured to set the predetermined number of pieces of the recording medium to be greater as the discharge interval is shorter.

2. The recording medium discharging apparatus according to claim 1;

wherein the recording medium includes a plurality of kinds of the recording medium having mutually different weights;

wherein the discharging mechanism is configured to discharge the plurality of kinds of the recording medium having mutually different weights on the support tray; and wherein the controller is configured to set the predetermined number of pieces of the recording medium to be smaller as weight of the recording medium used in the job is greater.

3. The recording medium discharging apparatus according to claim 1;

wherein the support tray includes a plurality of individual support trays; and wherein, in a case that the controller executes a job for continuously discharging a plurality of pieces of the recording medium at a predetermined discharging interval on a certain individual support tray among the plurality of individual support trays, the controller is configured to control the discharging mechanism to discharge the recording medium on another individual support tray among the plurality of individual support trays after discharging the predetermined number of pieces of the recording medium on the certain individual support tray since the detector detected the specific state.

4. The recording medium discharging apparatus according to claim 1;

wherein the controller is configured to measure a number of pieces of the recording medium discharged on the support tray after the detector has detected the specific state, and to pause the discharge of the recording medium on the support tray under a condition that the measured number of pieces of the recording medium reaches the predetermined number of pieces of the recording medium.

5. The recording medium discharging apparatus according to claim 1;

wherein the controller is configured to measure a period of time elapsed after the detector has detected the specific state, and to pause the discharge of the recording medium on the support tray under a condition that the measured period of time reaches a reference period of time corresponding to the predetermined number of pieces of the recording medium.

6. The recording medium discharging apparatus according to claim 5;

wherein, in a case that the controller continuously executes, as the job, first and second jobs having first and second discharge intervals which are mutually different and that the first job is completed before the predetermined number of pieces of the recording medium is discharged since the detector has detected the specific state and the detector is still detecting the specific state at a point of time at which the second job is started, the controller is configured to change the reference time to a second reference time corresponding to the second job, to convert a time required for completing the first job after the detector has detected the specific state with a ratio between the second reference time and a first reference time corresponding to the first job, and to remeasure the converted time as already-measured time.

7. The recording medium discharging apparatus according to claim 1;

wherein, in case that the controller continuously executes first and second jobs as the job, that the first job is completed before the predetermined number of pieces of the recording medium is discharged since the detector has detected the specific state and that the detector no longer detects the specific state, the controller is configured to decrease the predetermined number of pieces of the recording medium with respect to the second job.

8. The recording medium discharging apparatus according to claim 1;

wherein the controller has a memory storing a table associating the discharge interval of the recording medium with the predetermined number of pieces of the recording medium; and wherein the controller is configured to set the predetermined number of pieces of the recording medium based on the table stored in the memory.

9. A recording medium discharging apparatus configured to discharge a recording medium, comprising:

a support tray configured to support the recording medium;

a discharging mechanism configured to discharge a plurality of pieces of the recording medium on the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism;

wherein, in a case of executing a job for continuously discharging the plurality of pieces of the recording medium on the support tray at a predetermined discharging interval, the controller is configured to control the discharging mechanism to pause discharge of the plurality of pieces of the recording medium under a condition that the detector detects the specific state, and to resume the discharge of the plurality of pieces of the recording medium under a condition that the detector does not detect the specific state after a predetermined period of time has elapsed since detection of the specific state by the detector; and wherein the controller is configured to set the predetermined period of time to be greater as the discharge interval is shorter.

10. A non-transitory computer-readable medium storing a recording medium discharging program which is executable in a recording medium discharging apparatus including:

a support tray configured to support the recording medium;

a discharging mechanism configured to discharge a plurality of pieces of the recording medium to the support tray so that the plurality of pieces of the recording medium is stacked on the support tray;

a detector configured to detect a specific state in which a position of an uppermost surface of the plurality of pieces of the recording medium supported by the support tray is same as or higher than a predetermined position; and a controller configured to control the discharging mechanism;

wherein the recording medium discharging program comprises instructions which cause the controller to:

control the discharging mechanism, in a case that the controller executes a job for continuously discharging the plurality of pieces of the recording medium on the support tray at a predetermined discharging interval, to pause discharge of the plurality of pieces of the recording medium under a condition that the detector keeps detecting the specific state after a predetermined number of pieces of the recording medium is discharged on the support tray since the detector has detected the specific state; and set the predetermined number of pieces of the recording medium to be greater as the discharge interval is shorter.

* * * * *